US007153624B2

(12) United States Patent
Schultheis

(10) Patent No.: US 7,153,624 B2
(45) Date of Patent: Dec. 26, 2006

(54) PLASTIC TONER AND METHOD FOR PRODUCING SUCH A PLASTIC TONER

(75) Inventor: Bernd Schultheis, Schwabenheim an der Selz (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 10/494,828

(22) PCT Filed: Sep. 18, 2002

(86) PCT No.: PCT/EP02/10452

§ 371 (c)(1),
(2), (4) Date: May 7, 2004

(87) PCT Pub. No.: WO03/040833

PCT Pub. Date: May 15, 2003

(65) Prior Publication Data

US 2004/0259011 A1 Dec. 23, 2004

(30) Foreign Application Priority Data

Nov. 8, 2001 (DE) ..... 101 54 987

(51) Int. Cl.
*G03G 9/08* (2006.01)

(52) U.S. Cl. ..... 430/137.1; 430/105; 430/137.18

(58) Field of Classification Search ..... 430/137.21, 430/108.1, 105, 98, 137.1, 137.18
See application file for complete search history.

(56) References Cited

U.S. PATENT DOCUMENTS 3,888,678 A * 6/1975 Bailey et al. ..... 430/528
4,407,922 A * 10/1983 Grushkin et al. ..... 430/98
5,187,038 A * 2/1993 Gitzel et al. ..... 430/108.22
5,306,588 A * 4/1994 Tanaka et al. ..... 430/108.3
5,312,711 A * 5/1994 Tavernier et al. ..... 430/108.11
5,350,657 A * 9/1994 Anno et al. ..... 430/108.1
5,501,934 A * 3/1996 Sukata et al. ..... 430/108.1
6,365,312 B1 * 4/2002 Foucher et al. ..... 430/108.21

FOREIGN PATENT DOCUMENTS

DE 196 40 812 A1 5/1997
EP 0 640 883 A1 3/1995
EP 1 168 090 A1 1/2002

* cited by examiner

*Primary Examiner*—John L Goodrow
(74) *Attorney, Agent, or Firm*—Pauley Petersen & Erickson

(57) ABSTRACT

A toner and to a method for producing a plastic toner, especially for electrophotography. The base material for the toner, a powder for powder coating, is used and has a grain size distribution of from 1 to 20 μm, particularly 5 to 15 μm, and has additional charge control agents and additives on the surface. According to the method, convected powders for powder coating are used as the base material. In a mixing step, the powders are mixed with charge control agents (CCA) for improving surface charge and optionally in a further mixing step with additives for improving the flow properties, the adhesive power and the agglomeration propensity.

12 Claims, 1 Drawing Sheet

PLASTIC TONER AND METHOD FOR PRODUCING SUCH A PLASTIC TONER

BACKGROUND OF THE INVENTION

1. Field of the Invention

This invention relates to a plastic toner and a method for producing a plastic toner, in particular in connection with electrophotography.

2. Discussion of Related Art

Powders and methods for powder coating are known. Powders are used as materials which, depending on their areas of application and the connected requirements, in particular the surface properties, epoxides, polyesters, polyurethanes, acrylates and combinations of these materials. Such materials have a grain size between 3 and 100 μm. These materials are available in large amounts and are also inexpensive. Also, these materials are offered in almost all color shades.

Powder coating is a mature technique of industrial surface coating. The coating powder used in connection with this technique is a plastic powder with a hardener on a pressure-setting plastic base, which is free of solvents and is environmentally friendly. During the coating process, the plastic powder is applied electrostatically or by tribotechnological application to a grounded base material. Because of their charge, the powder particles adhere to the base material. The plastic is cured during subsequent heat application and forms a decorative surface image when viewed from the application side.

Particular toners are used in electrophotography, whose properties only offer rather limited possibilities.

SUMMARY OF THE INVENTION

It is one object of this invention to provide a toner and a method for producing the plastic toner, in particular in connection with electrophotography, which is inexpensive and which has properties that can be adapted to the most diverse surface requirements, and can be produced in a simple manner.

In accordance with this invention, this object is attained with a powder for powder coating, which has a grain size between 1 and 20 μm, in particular 5 to 15 μm, is used as the base material and has additional charge control agents and additives on the surface. The method for producing the toner is distinguished because finished convected powders are used for powder coating, which are charged in a mixing process with charge control agents (CCAs) for improving the surface charge and, if required, are charged in a further mixing process with additives for improving the flow rate, adhesiveness and the tendency for agglomeration.

The base materials are taken from plastic coatings which are offered in commerce with the most diverse properties and inexpensively and in all conceivable colors. Regarding the properties of the material, these base materials already correspond to a large extent to plastic toners such as used in connection with electrophotography. By charging the powders used as the base material with charge control agents and additives, in one or two mixing processes, it is possible to achieve the surface charge required for this purpose, as well as those properties improving the flow rate, the cleaning behavior and the tendency for agglomeration, which do not meet the requirements of electrophotography in the base materials for powder coating. During mixing, the base materials for powder coating are modified so that they can be used as plastic toners for electrophotography. Accordingly, large amounts of an inexpensive plastic toner with a large range of possibilities for adaptation to the requirements are available. If the base material does not lie within the desired grain range, an additional grinding and sifting process must first be performed, if necessary.

As in plastic powder coating, it is possible to make the selection of the initial materials so that epoxides, polyesters, polyurethanes, melamines, acrylates and other powder charge materials, as well as combinations of these materials, are used.

In this case, the adaptation to their use as plastic toners can occur in such a way that the charge control agents and the additives are selected as a function of the base material, and the selection of the charge control agents and additives is made in accordance with the properties of the surface chemistry, such as whether hydrophilic or hydrophobic plastics are used.

Additives, such as aerosils and/or silanes, can be used. The grain size can also be retained to a large extent wherein, in accordance with one embodiment aerosils and/or silanes are used as additives.

DESCRIPTION OF DRAWING

The graphic representation in FIG. 1 shows, by way of example, the course of the specific charge (q/m) in connection with differently prepared powder coating base materials as a function of the mixing time.

DESCRIPTION OF PREFERRED EMBODIMENTS

Figure 1:
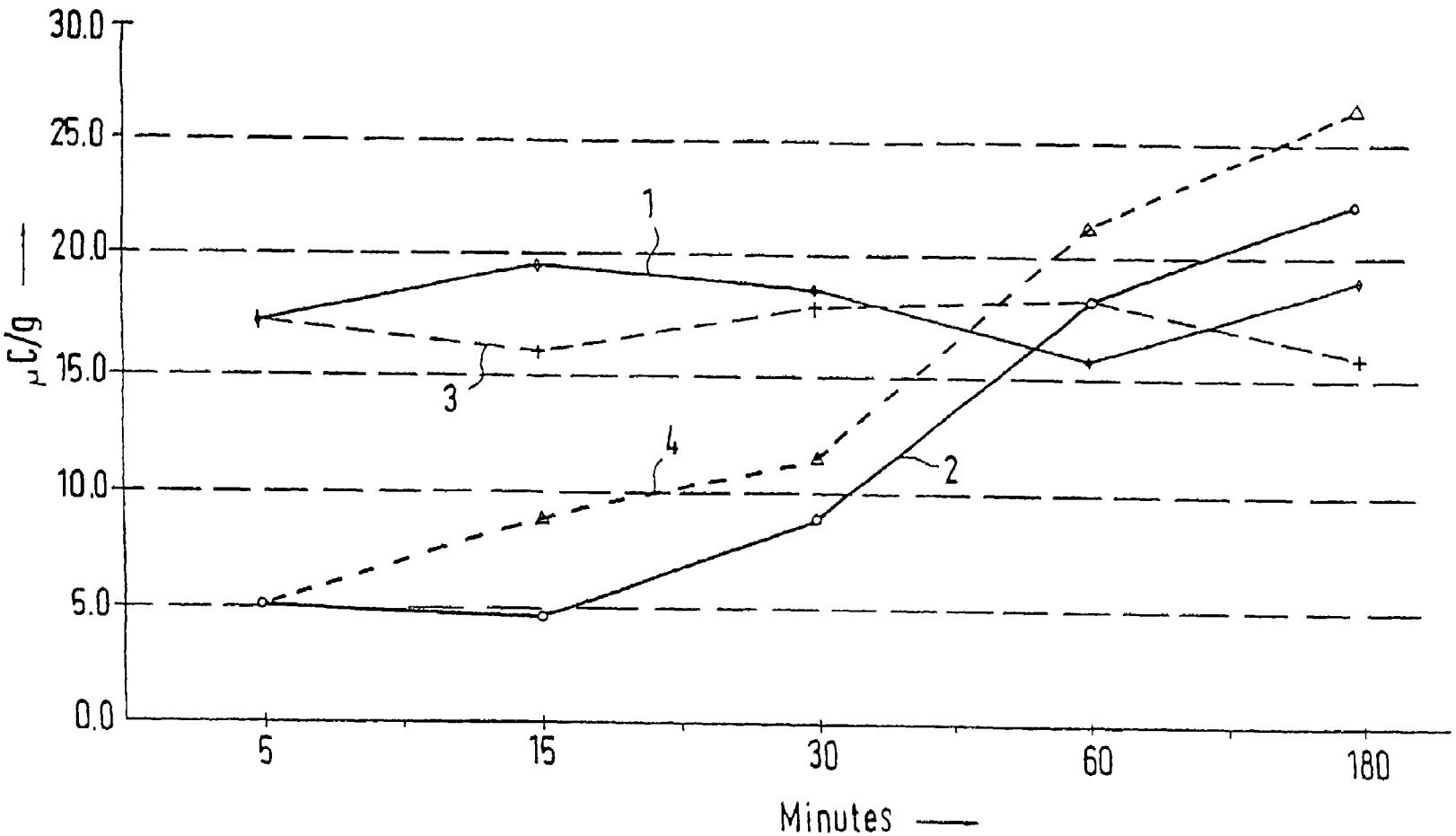

Curve 1 shows the chronological course for untreated base material.

Curve 2 shows the effect if, for example, 0.5% of charge control agents (CCAs) are admixed.

Curve 3 shows the course if 0.5% of aerosils are admixed.

Curve 4 shows the effects of 0.5% charge control agents and 0.5% aerosils.

The mixing process can be performed in an eccentric tumbling mixer or a vane mixer. A possibly previously performed grinding and sifting process for adapting the grain size distribution occurs in a counter-current grinder, for example.

The customary extrusion process can be omitted here. This is particularly advantageous if processing different colors one after the other within a short time, because in this case the time-consuming cleaning of the extrusion device can be omitted.

The invention claimed is:

1. A method for producing a plastic toner for electrophotography, the method comprising:

using finished convected powder as base materials for powder coating, the powder including a pressure-setting plastic base and a hardener and having a grain size distribution of 1 to 20 μm;

charging the powder in a dry mixing process with charge control agents for improving a surface charge, wherein a concentration of the charge control agents is selected between >0 and 5 weight-%;

charging the powder in a further mixing process with additives, wherein at least one of aerosils and silanes are employed as the additives and a concentration of the additives is selected to be between >0 and 5 weight-%;

wherein at least one powder charge material selected from the group including epoxides, polyesters, polyurethanes, melamines, acrylates, and combinations thereof are used as the base materials.

2. The process claim in accordance with claim 1, wherein the powder for powder coating has a grain size distribution of 5 μm to 15 μm.

3. The method in accordance with claim 2, wherein a grinding and sifting process is performed prior to the dry mixing process, which matches the grain size distribution in the base materials as required for electrophotographic transfer.

4. The method in accordance with claim 2, wherein the concentration of the charge control agents is <2 weight-%.

5. The method in accordance with claim 4, wherein the concentration of the additives is <2 weight-%.

6. The method in accordance with claim 3, wherein the dry mixing process is performed in one of an eccentric tumbling mixer and a vane mixer, and required grinding and sifting process is performed in a counter-current grinder.

7. A plastic toner for electrophotography produced according to the method of claim 6.

8. A plastic toner for electrophotography produced according to the method of claim 1.

9. The method in accordance with claim 1, wherein a grinding and sifting process is performed prior to the dry mixing process, which matches the grain size distribution in the base materials as required for electrophotographic transfer.

10. The method in accordance with claim 1, wherein the concentration of the charge control agents is <2 weight-%.

11. The method in accordance with claim 1, wherein the concentration of the additives is <2 weight-%.

12. The method in accordance with claim 1, wherein the dry mixing process is performed in one of an eccentric tumbling mixer or a vane mixer, and required grinding and sifting process is performed in a counter-current grinder.

* * * * *